United States Patent [19]

Dorrell et al.

[11] 3,970,352

[45] July 20, 1976

[54] ELECTRICAL CONNECTOR HAVING IMPROVED CONTACT RETENTION SYSTEM

[75] Inventors: Robert Francis Dorrell, Des Plaines; Joseph Janatka, La Grange Park, both of Ill.

[73] Assignee: Bunker Ramo Corporation, Oak Brook, Ill.

[22] Filed: Dec. 9, 1974

[21] Appl. No.: 530,619

Related U.S. Application Data

[63] Continuation of Ser. No. 291,573, Sept. 25, 1972, abandoned, which is a continuation-in-part of Ser. No. 885,123, Dec. 15, 1969, abandoned.

[52] U.S. Cl. ..... 339/59 M; 339/94 M

[51] Int. Cl.[2] ..... H01R 13/42

[58] Field of Search ..... 339/59–61, 339/94, 217

[56] References Cited

UNITED STATES PATENTS 3,165,369 1/1965 Maston ..... 339/59 M 3,477,061 11/1969 Stephenson ..... 339/59 M

*Primary Examiner*—Joseph H. McGlynn

*Attorney, Agent, or Firm*—William Lohff; F. M. Arbuckle

[57] ABSTRACT

An electrical connector including a plurality of conductive contacts with each contact having an enlarged shoulder between a body portion and a terminal portion in combination with a contact supporting and isolation means including a pair of dielectric body members, positioned on opposite sides of the contact shoulders with risers extending from the body members into contact positioning relationship with the contact shoulders, and a single isolation disc confined between the dielectric members with a plurality of holes therethrough closely surrounding the risers to provide an effective seal around and between the individual contacts.

6 Claims, 8 Drawing Figures

ELECTRICAL CONNECTOR HAVING IMPROVED CONTACT RETENTION SYSTEM

RELATED APPLICATIONS

This application is a continuation of pending application Ser. No. 291,573, filed Sept. 25, 1972 (now abandoned), which, in turn, was a continuation-in-part of then pending application Ser. No. 885,123, filed Dec. 15, 1969 (now abandoned).

Background of the Invention

The invention resides in a multi-contact electrical connector, well suited for sophisticated high density contact design, wherein the contacts may be releasably mounted so that any individual contact may be easily and quickly removed for inspection or replacement, yet with a contact-retention system such that the effective electrical insulation thickness between adjacent contacts is substantially greater than heretofore achieved with comparable contact sizes and spacing.

One of the principal objects of the present invention is to provide an electrical connector having a contact-retention system designed to utilize individual pin-and-sleeve contacts conforming precisely to existing industry standards, yet to provide thereby a connector having between-contact insulation thickness much greater than heretofore achieved by use of these same individual contacts at the same center-to-center contact distances.

A further object of the invention is to provide an electrical connector having a uniquely designed contact retention system capable of utilizing pin-and-sleeve contacts conforming precisely to existing industry standards yet to eliminate the need for the metal contact retention clips heretofore normally utilized with such contacts and to thus greatly increase the intercontact metal-to-metal distance achieved with similar center-to-center spacing. A further object of the invention is to achieve the above advantages by an improved contact retention design such that the individual contacts are nevertheless removable and replaceable without disturbing adjacent contacts and wherein the design of the intercontact insulating structure is such that there are no unbonded transverse parting lines or electrical creepage paths through which electrical leakage might take place.

A further object is to accomplish the above by a structural arrangement wherein the contacts may be individually removed or replaced by the use of the same conventional contact insertion and removal tools that have been heretofore used in connectors utilizing metal clips for securing the contacts in place. In fact, by the present invention, it is quite practical to construct connectors using industry standard contacts and interchangeably matable with heretofore known connectors in all operational respects, but with much improved internal insulation and consequent superior electrical isolation between circuits extending through the several contact pairs.

SUMMARY OF THE INVENTION

The advantages inherent in the present invention are obtained primarily by the provision of a unique and improved dielectric insert assembly for mounting the individual contacts in their respective positions. Preferably, this consists of two separate dielectric members, each including a thick insulating wall extending transversely of the connector shells, with one such wall near the forward portion of the plug or receptacle, as the case may be, and the other rearwardly thereof, with a space between the forward and rearward insert in which there is provided what we shall call an "isolation disc". This disc, while bonded to the forward and rearward inserts respectively (so as to leave no unbonded transverse parting line along which electrical leakage could occur) is nevertheless imperforate between snug apertures encircling the individual contacts, so that a maximum insulation thickness is attained between contacts, resulting in the best possible electrical properties in relation to the center-to-center spacing of the individual contacts. By this means, the present invention makes it possible to obtain an insulating wall thickness almost double the thickness achieved by present commercially used connectors utilizing precisely the same contacts and employing the same center-to-center spacing.

BRIEF DESCRIPTION OF THE DRAWINGS

Other advantages inherent in this disclosure will become apparent by reference to the following description of a preferred embodiment of the invention, shown in the drawings attached hereto and forming a part of the present specification wherein.

DESCRIPTION OF A PREFERRED EMBODIMENT

Figures 1, 2, 3, 4, 5:
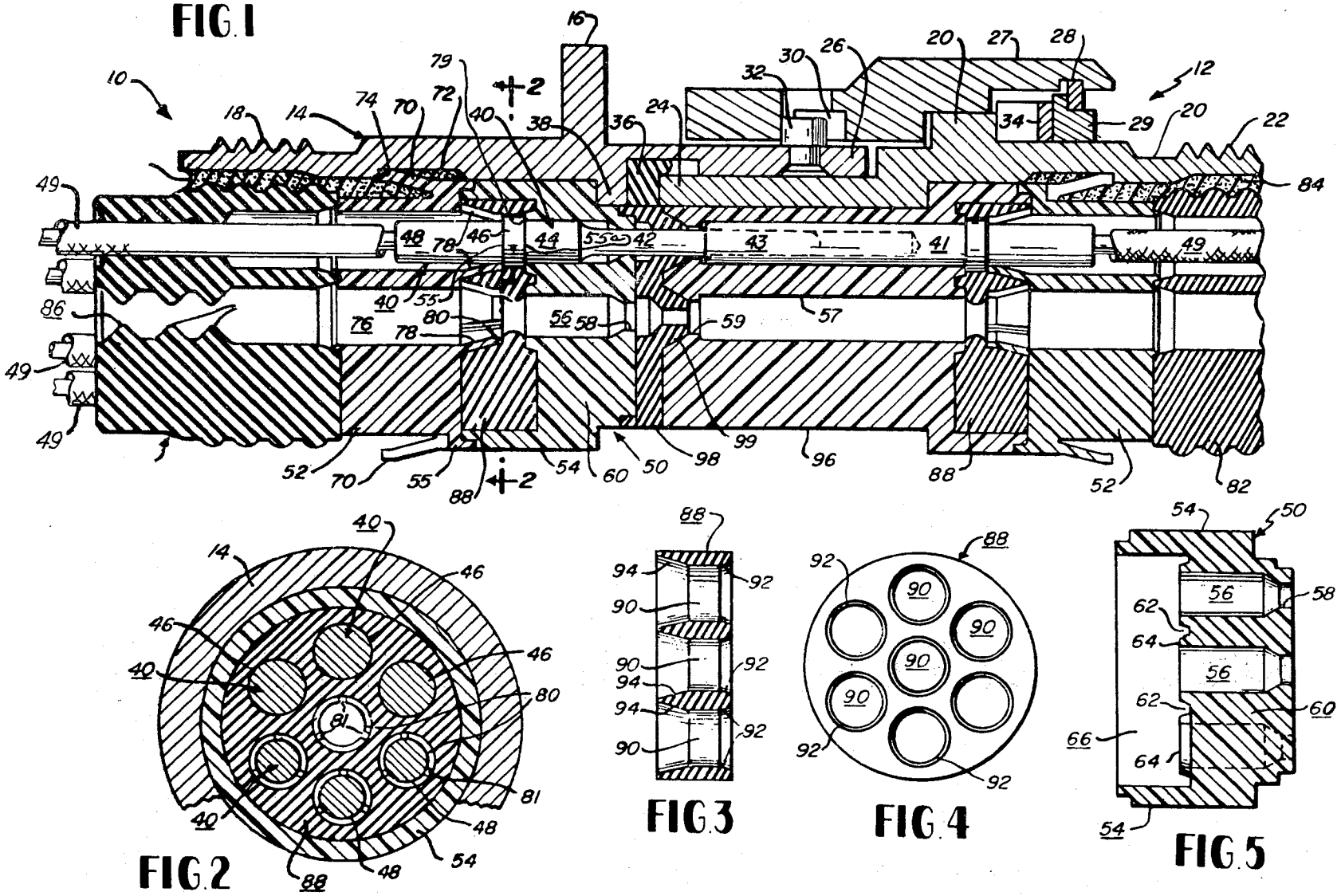
FIG. 1 is a greatly enlarged partial longitudinal sectional view through a connector constructed in accordance with this invention, taken substantially along the line 1—1 of FIG. 2 showing the plug and receptacle of the connector, with the center contacts removed for clarity of illustration, but otherwise in fully mated position.
FIG. 2 is a transverse cross-sectional view of the connector receptacle, taken substantially along the line 2—2 of FIG. 1.
FIG. 3 is a cross-sectional view of one of the isolation discs utilized in the contact retention systems of both the plug and the receptacle.
FIG. 4 is a front view of said isolation disc.
FIG. 5 is a sectional view of one of the dielectric contact mounting inserts employed as part of the contact retention system.

The exterior portions of the connector chosen as best illustrative of the principles of this invention are somewhat conventional in that the connector consists, in its overall arrangement, of a receptacle generally indicated at 10 and a plug portion generally designated at 12. As is usual, the plug is arranged for releasable engagement with the receptacle.

The receptacle 10 includes an exterior metallic shell 14 having a mounting flange 16 therearound and provided at the rearward or outer (left) end with a threaded portion 18 to accommodate a clamping nut, wire clamp or other conventional accessory. Similarly, the plug 12 of the connector is provided with an exterior conductive metal shell 20 having a screw-threaded portion 22 at the rearward (right hand) end.

As is conventional in the art, the shell 20 of the plug has a cylindrical leading end portion 24 extending into the forward sleeve portion 26 of the receptacle, and the plug and receptacle are held in engagement with each other by a rotatable coupling ring 27 secured to the plug shell by locking rings 28 and 29, and having helical bayonet slots 30 to engage corresponding detent pins 32 on the receptacle. The coupling ring 27 may also be provided with an internal spring washer 34 to keep the plug and receptacle in snug engagement in their coupled position. Also, as is conventional, a resilient sealing gasket 36 may be provided between the forward end of the plug shell 24 and the front face of an internal flange 38 within the shell 14 of the receptacle.

The individual conductive contacts 40 of the receptacle (shown in this particular instance as consisting of a pin portion 42 at the leading end, a body portion 44, an annular shoulder 46, and a terminal sleeve 48 adapted for attachment to a flexible, insulated wire lead 49) are all mounted in and between aligned cavities in coacting dielectric inserts or body portions 50 and 52, which form the first and second parts of a dielectric body member, shaped and dimensioned to be received within the sleeve-like receptacle shell 14 of the connector. Accordingly, the front face of the forward insert 50 extends through the aperture within the internal flange 38 but, as best seen in FIG. 1, the rearward portion of the insert is provided with an enlarged circular flange 54 fitted within the shell 14 and bearing against the internal flange 38 thereof. The forward portion of insert 50 consists of a thick, generally rigid transverse wall 60 provided with a plurality of separate parallel contact cavities 56 and each of these cavities has a reduced diameter forward aperture 58 through which the pin portions 42 of the contacts extend. The rearward ends of each of the contact cavities 56 of the dielectric insert 50 extend through a generally flat rearward face 62 of the wall 60 (FIG. 5) and terminate at the inner ends of annular riser portions 64, each surrounding one of the contact cavities 56 and projecting rearwardly from the generally flat wall 62 into a single common internal cavity 66 (FIG. 5) common to all of the contacts.

The rearward dielectric insert or contact retention disc 52 consists essentially of a single, generally round, thick, flat wall formed of dielectric material having some degree of flexibility and resilience and positioned within the cavity of the metal receptacle shell 14 in a position immediately to the rear of and in face-to-face relationship with the outer marginal edge of the flange 54 of the dielectric insert 50. As shown, this contact retention disc 52 is held in position by an outwardly tapering skirt portion 70 split at several points around the circumference of the disc so that the contact retention disc is forced into place from the rearward (left) of the receptacle shell 14, the skirt portions can be snapped into an undercut 72 of the receptacle shell and held in locking engagement with the forwardly facing shoulder 74 of the undercut. The retention disc 52 is provided with a plurality of generally cylindrical contact receiving cavities 76, each having a respective axis coaxial with the axis of the respective contact and aligned with a respective contact receiving cavity of the forward dielectric insert 50 but of somewhat greater diameter, for reasons that will appear presently.

At the forward end of each of the cavities 76 of the disc there is provided, however, a riser of generally cone-like shape, formed integrally with the contact retention disc 52 and comprising a plurality (in this instance 3) of plastic tines or resilient fingers 78 extending toward the contact and cavity axis and one end of the dielectric body member or inwardly and forwardly from the forward openings of the contact cavities to short semi-cylindrical extensions 80 at their innermost ends. It will be seen from the drawings that the resilient fingers 78 are formed integrally with each other and with the retention disc 52 or one part of the body member and each finger has a first cantilever portion spaced from the peripheral wall of the respective one coaxial portion 40 of the contact and a second cantilever portion engaging the peripheral surface or longitudinally extending surface portion of the respective coaxial portion 40 or contact to support the one coaxial portion whose peripheral wall is spaced from the wall of the respective contact receiving cavity in part 52. The second cantilever portion of each finger also engages one of the radial faces 55 of the enlarged diameter portion 46 to limit movement of the contact in one axial direction and an abutment or stop means 79 on the part 50 engages the other radial face **55*a* of the portion 46 to limit movement of each contact in the opposite axial direction. In the preferred embodiment of the invention, the wall thickness of these individual tines is uniform throughout and each tine extends at an angle of approximately 14° with respect to the central axis of the contact cavity which it surrounds. The individual tines are, however, separated from each other by slots or splits 81 (FIG. 2**) so that the tines may be spread as the contact is inserted without imparting a permanent set or other damage.

Adjacent to the rear surface of the contact retention disc 52 and preferably bonded thereto to effect a watertight and airtight seal there is relatively soft flexible silicone rubber grommet 82, bonded also to the shell 14 by potting compound 84. As is conventional, the grommet has apertures surrounding each of the conductors 49 extending from the several contacts, with each aperture being internally contoured at 86 to exclude vapor and moisture from entrance to the connector from the rear thereof. In order to effectively seal the interior of the connector receptacle against entrance of moisture, vapor or other foreign matter, the insert 52 is bonded to the insert 50 around the marginal edges of flanges 54 and 55. In addition, the individual contacts 40 are mechanically sealed and electrically isolated from each other by an isolation disc 88 (FIGS. 3 and 4) consisting of a generally flat, circular disc of yieldable silicone rubber insulating material of normal thickness somewhat greater than the space within the internal cavity 66 of insert 50 and thus compressed therein. The disc 88 is provided with a number of through holes 90 dimensioned to be snugly compressed around shoulder 46 of each of the contacts. The holes 90 are preferably outwardly tapered at 92 to closely fit the risers 64 at the forward face of the disc, and also tapered at 94 to fit snugly around the tines 78 projecting from the contact retention disc 52. The front and the rear faces of the isolation disc 88 are bonded to the interior surfaces of inserts 50 and 52 and, if desired, this bonding may extend over part or all of the tapered surfaces forming the outer peripheries of the risers 64 and the tines 78.

The plug of the connector has a contact retention member 52, isolation disc 88 and grommet 82 sealed in place by potting compound 84 in exactly the same manner as with the receptacle just described, but in this instance, the individual contacts 41 have internally resilient sleeve portions 43 at their forward ends to receive the pin portions 42 of the receptacle contacts. The forward insulating insert 96 is accordingly provided with cavities 57 and apertures 59 corresponding to the shape of the sleeve portions of the contacts.

To provide an adequate seal between the plug and receptacle, a relatively soft silicone rubber gasket is placed in compression between the forward faces of the inserts 50 and 96 and this gasket is preferably provided with somewhat conical projections 99 to afford a tighter seal around the individual contacts at the tapered forward ends of the aperture 59 of the contact cavities of insert 96.

Figure 6:
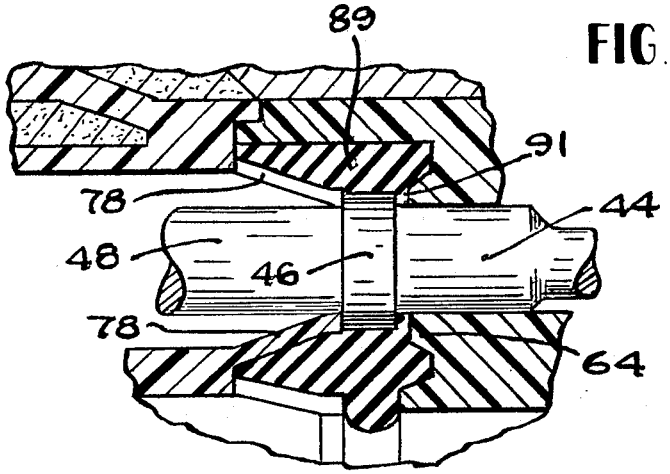
FIG. 6 is an enlarged cross sectional view of another embodiment of the contact retention system illustrated in FIG. 1.

FIG. 6 is illustrative of another embodiment of the contact retention system for contact shoulder 46 illustrated in FIG. 1. As illustrated, disc 89 may be formed with annular ring 91 disposed between and in engaging relationship with shoulder 46 and riser 64. In this arrangement, riser 64 serves the same purpose as described above for riser 64 in FIG. 1 and extends towards and in contact positioning relationship with contact shoulder 46 for positioning contact 40 in cavities 56 and 76 and hole 90. Tines 78 engage contact shoulder 46 and may be spread outwardly by means of a suitable tool to permit rear removal of contact 40.

Figure 7:
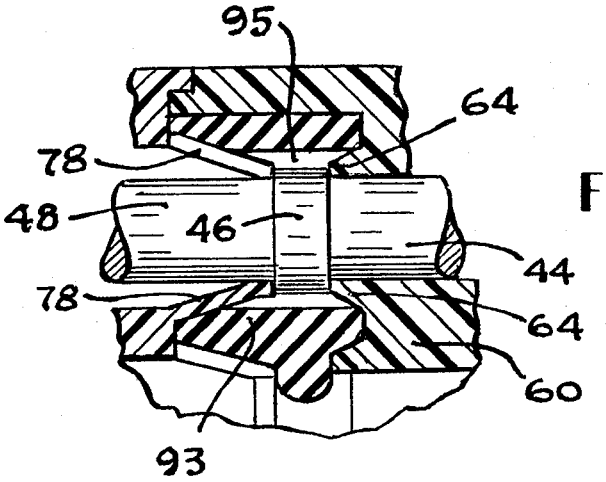
FIG. 7 is also an enlarged cross sectional view of a further embodiment of the contact retention system illustrated in FIG. 1.

FIG. 7 is illustrative of further embodiment of the contact retention system for contact shoulder 46 illustrated in FIG. 1 and includes a construction in which disc 93 is slightly spaced apart from shoulder 46. Particularly when disc 93 is composed of rubbers such as the soft silicon rubbers having significant thermal expansion, this separation 95 is often useful to accommodate the expansion of disc 93 when the connector is exposed to elevated temperatures. Also, deformation of disc 93 under compressive confinement between body members 50 and 52 can expand disc 93 into part or all of separation 95 while disc 93 engages risers 64 and 78 in the desired sealing relationship. When disc 93 is composed of rubbers with reduced tendencies of expansion and deformation, the size of separation 95 in the initial assembly can be reduced accordingly.

Figure 8:
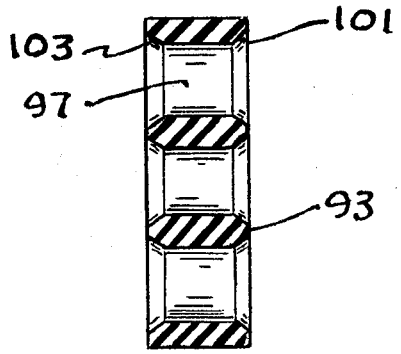
FIG. 8 is a view of an isolation disc similar in size to that of FIG. 3, illustrating in cross section the isolation disc utilized in the contact retention system illustrated in FIG. 7.

Disc 93 utilized in the connector of FIG. 7 is further illustrated in FIG. 8 and includes a plurality of holes 97 slightly tapered at 101 and 103 to fit around risers 64 and 78. Between the tapers at 101 and 103, holes 97 are of generally constant diameter to provide a spacing between shoulder 46 and disc 93.

As stated earlier in the present specification, it is one of the prime objects of the invention to provide an improved contact retention system designed to utilize contacts made in strict accordance with certain existing industry standards and specifications, yet to achieve greatly improved electrical insulation characteristics without sacrifice of any of the desirable features of the existing connectors for which such industry standard contacts have been designed. In the present instance, the contacts 40 and 41 may be made in exact accordance with National Aerospace Standards NAS 1662 and NAS 1663, promulgated by Aerospace Industries Association of America, Inc. under procurement specification NAS 1600.

In the prior art, however, pin and socket contacts according to these specifications have been used only in connection with connectors employing some type of metallic spring clip arranged to surround and engage the annular shoulders of the contacts to hold them in place. By this means, the contacts are individually removed or replaced by insertion of a sleeve-like removal tool inwardly through the grommet at the rear of the plug or receptacle to engage and spread the metal contact clip sufficiently to allow the contact shoulder to be withdrawn. While this arrangement is satisfactory for some applications, the metal-to-metal distances between the contact clips have been so short that these connectors leave much to be desired from a standpoint of insulation and voltage breakdown capabilities.

This disadvantage of the prior art is well overcome in the present invention, since all or primarily all of the space between the contact shoulders 46 is taken up by the compressed insulating material of the isolation disc 88 (or discs 89 and 93) and the risers extending inwardly toward the front and rear of the contact retention shoulders provide relative long electrical creepage paths even at the closest point between the individual contacts. At the same time, the contacts 40 and 41 may in each instance be removed by insertion of a conventional removal tool through the aperture in the grommet, with the sleeve-like portion thereof surrounding the flexible wire conductor 49 to slip through the oversize cavity 76 in the retention disc and over the terminal sleeve 48 of the contact, in order to spread the tines 78 enough to release the contact for withdrawal towards the rear of the plug or receptacle, as the case may be. The relatively soft silicone rubber, of which the isolation discs 88, 89 and 93 are formed, permits the tines 78 of the contact retention disc to spread enough to accommodate the central enlarged shoulders of the contacts so that any individual contact may be easily removed or replaced by exactly the same mechanical operation as heretofore required in connectors utilizing metal contact retaining clips. When the contacts are in place, however, the resiliency of the silicone rubber of the isolation disc lends support and strength to the individual tines 78 in a manner to increase their strength and thrust-resisting capability, so that they are more than adequate to withstand the normal forces incident to coupling and uncoupling the connector plug and receptacle. Nevertheless, replacement of individual contacts is achieved without the necessity of dismantling the connector or its inserts in any way, and yet with a design such that there are no unbonded parting lines extending transversely of the connector plug or receptacle.

What is claimed is:

1. In an electrical connector, in combination, a plurality of parallel conductive contacts, each having a terminal portion, a body portion and an enlarged shoulder between said body portion and said terminal portion; in combination with contact-supporting and isolation means consisting of one dielectric body member comprising a transverse wall of insulation material having a plurality of parallel contact-receiving cavities closely surrounding the body portions of said contacts with risers around each contact extending from the aforesaid dielectric body toward and in a contact positioning relationship with the aforesaid contact shoulder; a second dielectric body member comprising a transverse wall of insulating material having a plurality of parallel contact-receiving cavities surrounding the terminal portions of the individual contacts with risers extending from the said second dielectric body toward and in a contact positioning relationship with the aforesaid contact shoulder; together with a single isolation disc confined between said dielectric body members, each of said risers having an outer periphery, said isolation disc having a plurality of holes therethrough closely surrounding the risers and being disposed in a sealing relationship with at least a portion of the outer periphery of each riser, said isolation disc being imperforate between said holes to provide an effective seal around and between the individual contacts; the risers of at least one of the dielectric body members extending into engagement with said contact shoulders.

2. The combination in claim 1 wherein said disc is radially spaced slightly apart from said contact shoulder.

3. In an electrical connector, in combination, a plurality of parallel conductive contacts, each having a terminal portion, a body portion and an enlarged shoulder between said body portion and said terminal portion, in combination with contact-supporting and isolation means consisting of one dielectric body member comprising a transverse wall of insulation material having a plurality of parallel contact-receiving cavities closely surrounding the body portions of said contacts with risers around each contact extending from the aforesaid dielectric body into engagement with the aforesaid contact shoulder; a second dielectric body member comprising a transverse wall of insulating material having a plurality of parallel contact-receiving cavities surrounding the terminal portions of the individual contacts with risers extending from said second dielectric body and into engagement with said contact shoulder; together with a single isolation disc confined between said dielectric body members; said disc having a plurality of holes therethrough closely surrounding the shoulders of the contacts and the risers extending thereto; said isolation disc being disposed in sealing relationship with said risers and imperforate between said holes to provide an effective seal around and between the individual contacts.

4. The combination of claim 3 wherein the contact shoulders are of annular form and the risers are integral with their respective body members and of circular form, tapering inwardly from the walls thereof to the contact shoulders.

5. The combination of claim 4 wherein the risers extending from one of the dielectric members comprise a plurality of yieldable plastic tines adapted to expand against the isolation disc to permit insertion or removal of an individual contact therethrough, and wherein the contact-receiving cavities in said dielectric body are of a diameter at least as great as the maximum diameter of the individual contact shoulders to permit insertion and removal of said contacts.

6. The combination of claim 5 wherein the contact isolation disc is held in compression between generally flat walls of the body members and bonded to the surfaces of said members, to eliminate transverse electrical creepage paths through the contact retention assembly.

* * * * *